US006409331B1

(12) United States Patent
Gelbart

(10) Patent No.: US 6,409,331 B1
(45) Date of Patent: Jun. 25, 2002

(54) METHODS FOR TRANSFERRING FLUID DROPLET PATTERNS TO SUBSTRATES VIA TRANSFERRING SURFACES

(75) Inventor: Daniel Gelbart, Vancouver (CA)

(73) Assignee: Creo Srl, Burnaby (CA)

( * ) Notice: Subject to any disclaimer, the term of this patent is extended or adjusted under 35 U.S.C. 154(b) by 0 days.

(21) Appl. No.: 09/654,247

(22) Filed: Aug. 30, 2000

(51) Int. Cl.[7] ..... B41J 2/01
(52) U.S. Cl. ..... 347/103
(58) Field of Search ..... 347/103, 120, 347/123, 111, 159, 141, 151, 55, 127, 128, 17, 154, 20; 399/271, 290, 292, 293, 294

(56) References Cited

U.S. PATENT DOCUMENTS

| | | | |
|---|---|---|---|
| 4,232,324 | A | 11/1980 | Tsao |
| 4,272,771 | A | 6/1981 | Furukawa |
| 4,293,866 | A | 10/1981 | Takita |
| 4,538,156 | A | 8/1985 | Durkee |
| 4,673,303 | A | 6/1987 | Sansone |
| 4,809,016 | A | 2/1989 | Padalino |
| 5,070,345 | A | 12/1991 | Lahut |
| 5,099,256 | A | 3/1992 | Anderson |
| 5,124,720 | A | 6/1992 | Schantz |
| 5,398,053 | A | 3/1995 | Hirosawa |
| 5,796,418 | A | 8/1998 | Silverbrook |
| 5,953,034 | A | 9/1999 | Salomon |

OTHER PUBLICATIONS

Allen, Ross R., "Ink Jet Printing with Large Pagewide Arrays: Issues and Challenges", Final Program and Proceedings, IS&T's NIP12, International Conference on Digital Printing Technologies, Oct. 27–Nov. 1, 1996, San Antonio, TX, pp. 43–49.

*Primary Examiner*—Raquel Yvette Gordon
(74) *Attorney, Agent, or Firm*—Oyen Wiggs Green & Mutala

(57) ABSTRACT

In accordance with the present invention, an inkjet pattern with high dot integrity is printed on a wide range of paper types with high reliability at speeds comparable to offset printing. The method consists of a combination of steps by which ink droplets, ejected from an inkjet array head with built in redundancy, are deposited in-line to avoid visual imperfections and are heated on a patterned intermediate transfer surface to decrease their size and increase their viscosity before being transferred to a printing surface. Dots immediately adjacent to one another in the pattern are printed in separate passes to retain dot integrity.

12 Claims, 6 Drawing Sheets

METHODS FOR TRANSFERRING FLUID DROPLET PATTERNS TO SUBSTRATES VIA TRANSFERRING SURFACES

CROSS-REFERENCES TO RELATED APPLICATIONS

The subject matter described herein is related to the subject matter of U.S. patent application Ser. No. 09/071,295 filed on Apr. 29, 1998 and entitled IMPROVED RESOLUTION INKJET PRINTING; and U.S. patent application Ser. No. 09/107,902 filed on Jun. 19, 1998 and entitled MULTIPLE PASS INK JET RECORDING.

Not applicable

REFERENCE TO MICROFICHE APPENDIX

Not applicable

1. Field of the Invention

The invention pertains to the general field of printing and in particular to the speed, reliability and reproduction quality of inkjet printing.

2. Background of the Invention

Ink jet is a low cost and effective method for deposition of any material in fluid form in numerous applications, mainly in printing. It has made the entire revolution in desk-top publishing possible and has become the mainstay color printing technology for home office use.

Ink jet printing, however, suffers form a number of drawbacks. The printing speeds achievable do not in general match those achievable using traditional offset printing, nor does inkjet printing match offset printing as regards printing quality attainable.

As regards print quality, inkjet printing is often characterized by a distinctive banding pattern that is repeated over the printed image. This may be traced to the very arrangement of the inkjet nozzles in the printing head. Relatively small nozzle misalignments or off-center emission of droplets are often at the root of this problem. As the printing head is translated laterally across the width of the printing surface, the visual imperfections are therefore repeated with perfect periodicity, producing the characteristic inkjet printer banding or striping. A number of approaches exist to address this matter, but they invariably have a negative effect on the throughput of the printer as a whole. This is a debilitating price to pay in the volume printing industry where time and throughput are of the essence. There is a clear need for a method that addresses visual imperfections in inkjet printing, of which banding is just one example, without compromising throughput.

A further point in the arena of print quality is the matter of "wicking" or "running". The water-based ink typically employed in ink-jet printers tends to "run" along the fibers of certain grades of paper. This phenomenon is also referred to as "wicking" and leads to reduced quality printing, particularly on the grades of paper employed in volume printing. The final printed dot is often much larger than the droplet of ink emerging from the inkjet nozzle and the integrity of the dot is lost in the process.

In order to obtain better quality prints from inkjet printers it is therefore often necessary to employ specially treated paper at high unit cost in order to ensure that the ink deposition process is under greater control during printing. This issue is directly traceable to the low viscosity of water-based inks. There is a clear need to be able to print on papers having a wider range of paper quality using low viscosity inkjet inks.

The linear printing speed of inkjet printing is of the order of 10 times slower than offset printing and in an industry where throughput and time are dominant considerations. This represents a major issue limiting the implementation of inkjet technology in industrial printing systems. The inkjet printing speed limit is dictated by the rate at which the miniature inkjet ejection capsules can eject ink in discrete controllable amounts. This rate is at present of the order of 20,000 pulses per second. This limits state of the art inkjet printers to print rates of the order of 2 pages per second, falling far short of the offset printing rate. For inkjet printing to be implemented on a wider scale in industry, the printing throughput must therefore be increased.

The matter of failure in nozzles is also deserving of attention. Many approaches exist for detecting faulty inkjet nozzles and for re-addressing the inkjet printing head in order for other nozzles to perform the task of the faulty one. This includes various redundancy schemes. Again, these usually have the effect of slowing down the net printing process speed. In many cases the redundancy is managed at printing head level, requiring backups for entire printing heads. This adds to the cost of the technology per printed page and again limits the industrial implementation of the technology. There is a clear need for the backup nozzles at lower cost per printed page and without reducing the throughput.

The prior art describes various array inkjet print head designs aimed at reducing inkjet-printing artifacts such as banding. Examples are Furukawa in U.S. Pat. No. 4,272,771, Tsao in U.S. Pat. No. 4,232,771, Padalino in U.S. Pat. No. 4,809,016 and Lahut in U.S. Pat. No. 5,070,345. Considerable work has also been done in addressing reliability by providing inkjet nozzle redundancy. Examples are Schantz in U.S. Pat. No. 5,124,720, Hirosawa in U.S. Pat. No. 5,398,053 and Silverbrook in U.S. Pat. No. 5,796,418. Transfer rollers have also been described, both with and without the droplets deposited on them being processed in some way before final printing in order to reduce wicking. See for example Takita in U.S. Pat. No. 4,293,866, Durkee in U.S. Pat. No. 4,538,156, Anderson in U.S. Pat. No. 5,099,256, Sansone in U.S. Pat. No. 4,673,303 and Salomon in U.S. Pat. No. 5,953,034.

BRIEF SUMMARY OF THE INVENTION

This invention provides methods for printing inkjet patterns with high dot integrity on a wide range of media. The methods comprise depositing fluid droplets which nay comprise ink droplets from fluid droplet sources onto an intermediate transfer surface. The methods change the properties of the ink droplets after they have been emitted from the fluid droplet sources. Changing the properties of the droplets may comprise decreasing their size and increasing their viscosity. Dots immediately adjacent to one another in the pattern may be printed in separate passes to retain dot integrity.

BRIEF DESCRIPTION OF THE DRAWINGS

In drawings which illustrate embodiments of the invention.

DETAILED DESCRIPTION OF THE PREFERRED EMBODIMENT

Figure 1:
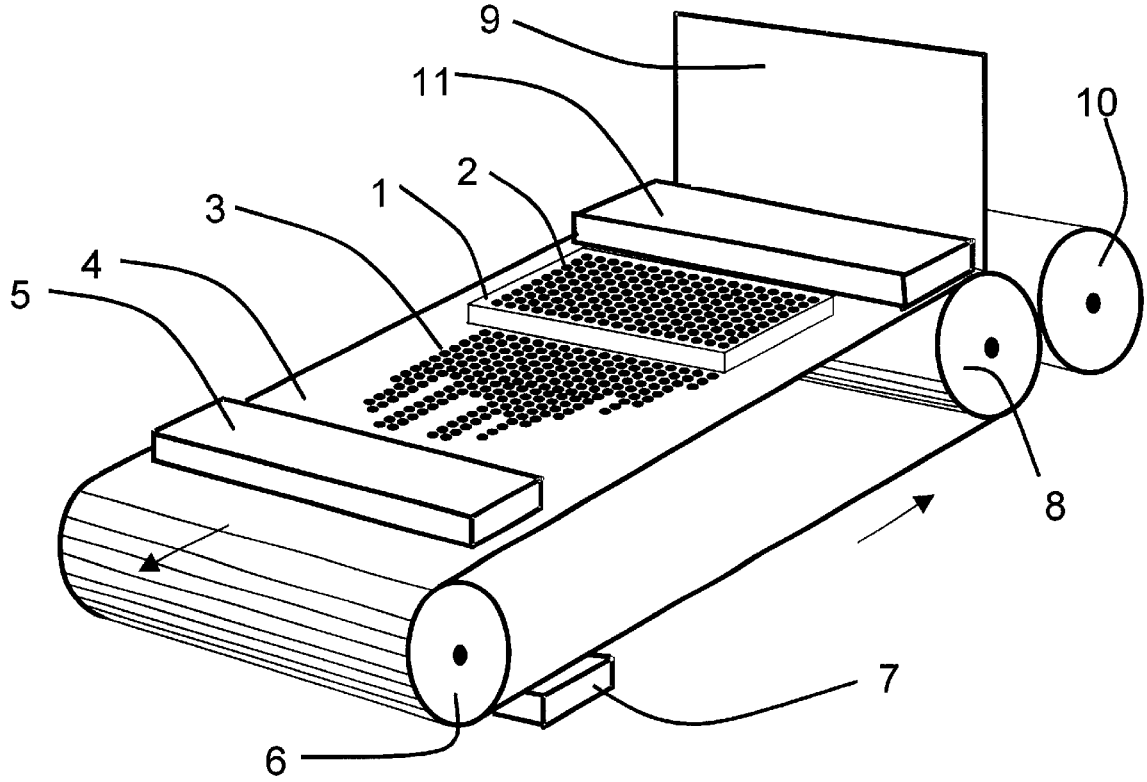
FIG. 1 shows a single two-stage fluid droplet transfer unit.

FIG. 1 schematically illustrates the essence of the preferred embodiment of the image transfer method. An inkjet head 1 comprising rows and columns of inkjet nozzles 2 deposits a fluid droplet pattern 3 on a transfer surface comprising a continuous belt 4 moving in the direction given by the arrows. While inkjet nozzles are employed herein as the preferred embodiment of the invention, in the general case the fluid droplet sources may be of any type and the fluid may be an inkjet ink or another ink, a pigment or a resin or any fluid required to create an image or pattern. In the present preferred embodiment the invention shall be described on the basis of inkjet nozzles and inkjet ink.

The inkjet droplet pattern 3 is subjected to post-deposition processing by post-deposition processing unit 5 to change the properties of the ink droplets. While the post-deposition treatment may be any of a variety of techniques, such as for example irradiation with ultra-violet light, vacuum treatment, airflow or chemical treatment, the embodiment presented here is based on heat treatment, including microwave heating, as the preferred process. This is presented in more detail in FIG. 2. The purpose of this treatment is to control the size of the fluid droplets and to change their rheological properties in particular. One example of such a rheological change is increasing the viscosity of the droplets.

Returning now to FIG. 1, the continuous belt 4 returns over the roller 6 and is cooled by a belt-cooling unit 7 that returns it to a temperature compatible with the medium of the substrate to be printed upon. The continuous belt is chosen as a transfer surface to address the matter of the heating of the droplets. A considerable amount of energy is required for the heat treatment and the transfer surface on which the droplet pattern is deposited must cool down before being brought into contact with the printing surface 9. The choice of a continuous belt as transfer surface allows both a more aggressive treatment of the droplets and the maximum amount of time for natural cool-down whilst maintaining a continuous process. The belt-cooling unit 7 is nevertheless added to ensure maximal control over the cooling process and the belt behavior. In situations where one of the alternative treatments described above is implemented by unit 5, unit 7 will be a unit to counter the residual effects of the treatment implemented by unit 5.

The cooled continuous belt 4 returns around hard printing roller 8 that rolls the printing surface 9 against an elastomeric roller 10. The choice of an elastomer as the material for a counter-roller to a hard roller is standard practice in the industry. Here the inkjet droplet pattern 3 is transferred to the printing surface 9, which may be paper, polymeric or other material and which may be in the format of individual sheets or in the form of a continuous roll. The invention is by no means limited to standard printing media as it also applies to any substrate to which a fluid-droplet pattern may be transferred, for example a printed circuit board or a lithographic mask. The heat treatment of the droplets described above serves to facilitate droplet transfer with the greatest possible dot integrity, which shall, in what follows, be understood as the geometric perfection of the outline of a dot on the printing surface and consistency of that outline from dot to dot. Dots that are deformed from a geometric shape anticipated by the design of the nozzles and the transferring surface, or droplets that have coalesced, therefore represent a loss in dot integrity.

The continuous belt 4 is then cleaned by a pre-cleaning unit 11 that removes remaining ink and pre-treats the surface of the continuous belt 4 in preparation for the deposition of the next run of inkjet droplet pattern 3. To the extent that it is necessary to control the affinity of the surface of the continuous belt for the fluid droplets being deposited on it, the pre-cleaning unit 11 also has the facility to clean the surface of the continuous belt using a liquid hydrophobic cleansing agent which may be sprayed on or wiped on.

Figure 2A:
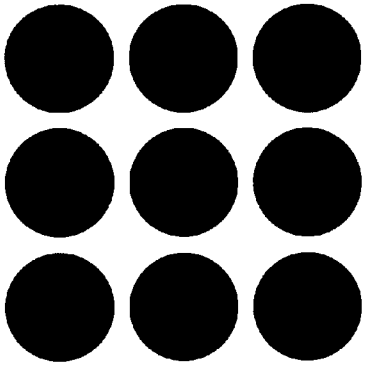
FIG. 2*a* shows an inkjet droplet pattern deposited on a transfer surface.
Figure 2B:
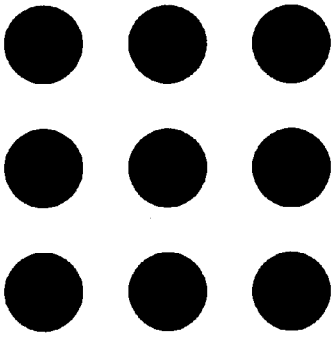
FIG. 2*b* shows the inkjet droplet pattern on the transfer surface after processing.

In FIGS. 2*a* to 2*d* we consider now the heat treatment process in more detail. In order to address the "wicking" or "running" effect that obtains with inkjet printing on regular printing paper, the inkjet droplets are deposited on the continuous belt transferring surface 4 in the form of a droplet pattern 3 dictated by the control instructions to the inkjet nozzles 2. FIG. 2*a* shows the droplets as deposited on that surface. In FIG. 2*b* the droplets have been heated and much of the solvent in the droplets, being water in the case of most industrial inkjet inks, has been turned to vapor. In this process the droplet shrinks significantly and the rheological properties of the droplet change. In particular, the viscosity of the droplets increases. In the process the surface tension of the droplets ensures that they maintain integrity as they reduce in size due to the loss of water.

Figure 2C:
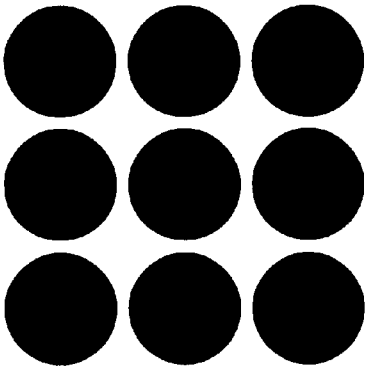
FIG. 2*c* shows the inkjet droplet pattern after transfer to a printing surface.

This pattern of reduced size, higher viscosity droplets is then transferred to the printing surface. The increased viscosity of the droplets reduces the "wicking" or "running" of the droplets along the fibers of the printing surface during the transfer of the droplets to the printing surface. In the transfer process, the droplets are flattened and therefore the dot size increases upon transfer. The dot size on the printing surface is controlled by the choice of processing temperatures and transfer pressures on the rollers and the paper. The result is shown in FIG. 2*c*.

Because of the increased viscosity of the droplets there is now greater control over the inkjet printing process, making it possible to employ a wider range of grades of paper and yet maintain the dot integrity of the pattern as deposited on the continuous belt. In particular, it allows standard high volume printing paper, as used in the offset-print industry, to be employed in the inkjet printing process. In what follows, paper that has not specifically been treated for purposes of inkjet printing, shall be referred to as being "regular paper".

By way of example, a material that may be used as transfer surface is PEARLdry waterless printing plate supplied by the Presstek company of Hudson, N.H. It may be coated with Scotchgard™ Leather Protector from the 3M company of St. Paul, Minn. to make it hydrophobic. The ink may be that employed in the HPC4844A cartridge supplied by the Hewlett-Packard company of Palo Alto, Calif. and it may be deposited as fluid droplets on the treated plate by means of an inkjet head from an HP 2000C inkjet printer supplied by the same company. A range of droplet sizes may be obtained by this means. By one choice of printing conditions, the droplets so obtained are 25 microns in diameter as deposited on the plate, shrink to 20 microns in diameter upon heating at 120 degrees Centigrade for 60 seconds, and widen to 35 microns in diameter when printed onto regular paper, not specially treated for inkjet printing. When conventional inkjet printing is employed, the same ink and head will print irregularly shaped dots of the order of 75 microns in diameter on regular paper.

It should be noted that, in order to achieve adequate coverage and a complete set of greytones or color densities, the droplet pattern needs to be so arranged that immediately adjacent nearest neighbor droplets will overlap to some degree on the final printing surface or substrate. This overlap arrangement of immediately adjacent dots may be understood with reference to FIG. 2*d*. If droplets occupying all possible positions in the pattern are deposited on the transfer surface at the same time, then there is a likelihood that they will at least touch and coalesce, with consequent loss of dot integrity.

Figure 2D:
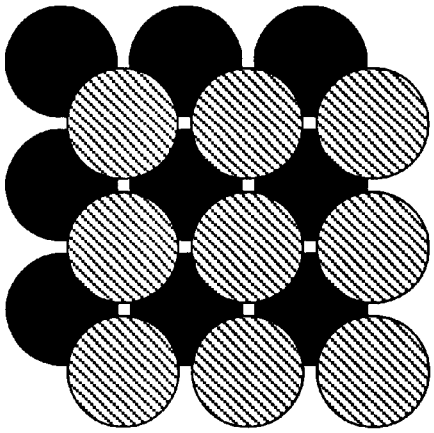
FIG. 2*d* shows the inkjet droplet pattern after transfer of a second set of inkjet droplets. The first set of droplets is shown in solid shading and the second set is shown hatched.

Print dot integrity may be ensured by performing the printing process in two or more steps using the process described in FIG. 2*a, b* and *c*. In the preferred embodiment, droplets intended to occupy immediately adjacent positions in the final printed pattern are deposited in separate steps. In the first step a first subset of droplets is deposited such that immediately adjacent nearest neighbor droplet positions are not occupied. In FIG. 2*d* the printing dots so obtained are depicted as solid dots. During a second step an interleaved subset of dots, depicted by the hatched dots in FIG. 2*d* and representing droplet positions in the final printed pattern that would be immediately adjacent nearest neighbors to the first subset, may be printed. The two steps may be achieved by either running the paper through the same printing system twice or by having two entirely separated printing systems operating serially on the same continuous roll of printing paper.

In the preferred embodiment the fluid used to print with is water-based industrial inkjet ink and at least two printing units are employed. In a more general case any number of such printing units may be used. These printing units deposit the droplets in the fashion described by FIGS. 2*a–d*. By this method no two droplets ever touch each other during the entire transfer process, unless they have first been through post-deposition processing, and hence the droplets have no opportunity to coalesce in the un-processed state and thereby lose their integrity while residing on the continuous belt transfer surface.

Figure 3:
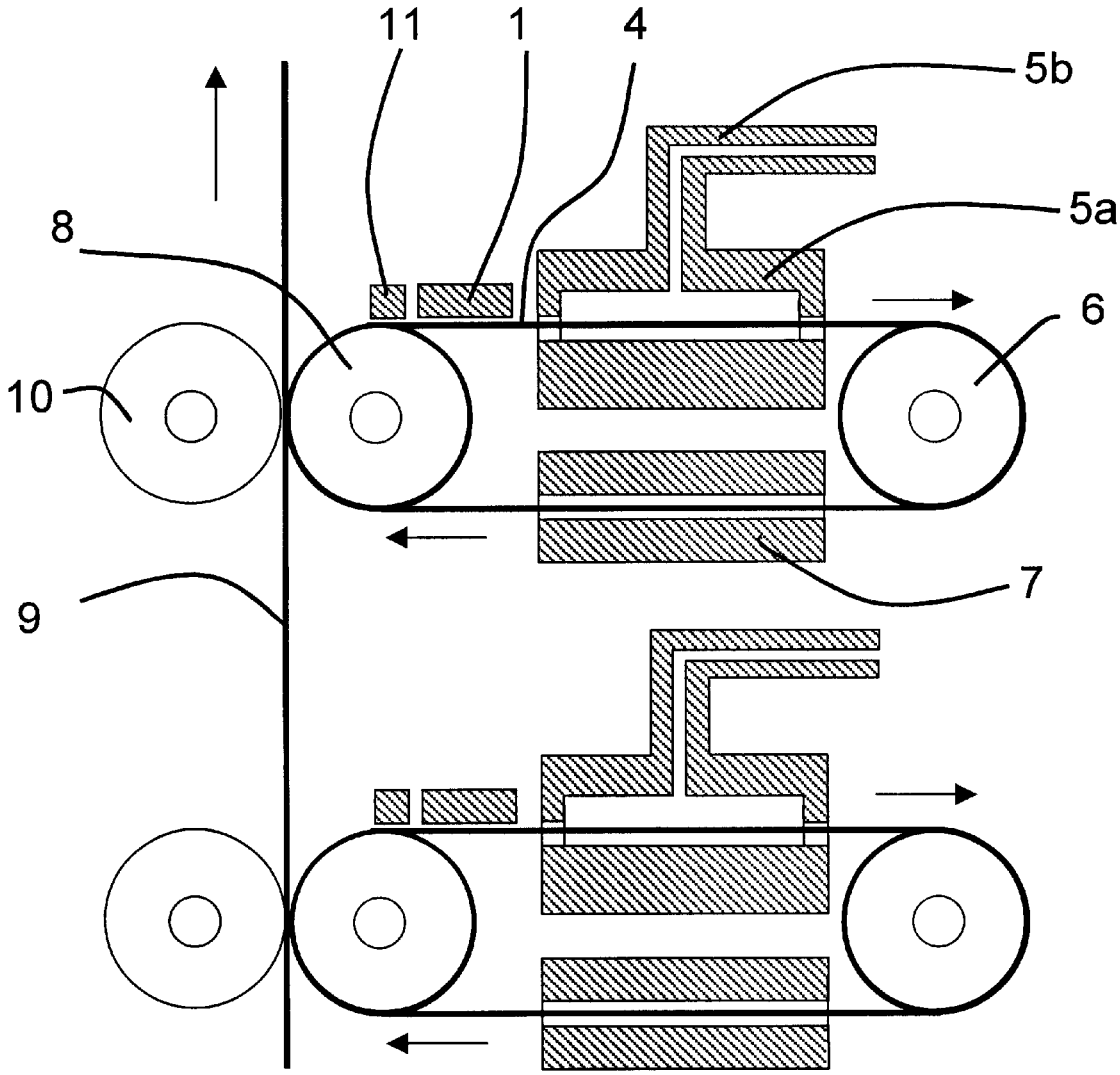
FIG. 3 shows two two-stage fluid droplet transfer units arranged to print two inkjet droplet patterns in succession on th e same printing surface.

In FIG. 3 a system containing two printing units in series is shown. The two units are identical and hence only one is numbered as in FIG. 1 for the sake of clarity. The post-deposition processing unit 5 earlier depicted in FIG. 1 is here shown in more detail in the form of a thermal processing unit. Each such thermal processing unit 5 has, besides its basic heating system 5*a*, also a vapor extraction unit 5*b* that forcibly removes the water vapor generated from the heated fluid during processing. The printing surface 9 depicted in FIG. 1 is shown here as being continuous and moving in the direction indicated by the arrow.

The importance of the belt-cooling unit 7 also extends to the control of printing registration when multiple printing units are employed. The belt-cooling unit, in addition to cooling the belt before it reaches the printing surface, serves also to ensure that the belt length remains under control in aligning the printing patterns from two or more printing units as depicted in FIG. 3. Synchronization control systems for continuous belts are well established and will not be entered upon here.

Figure 4:
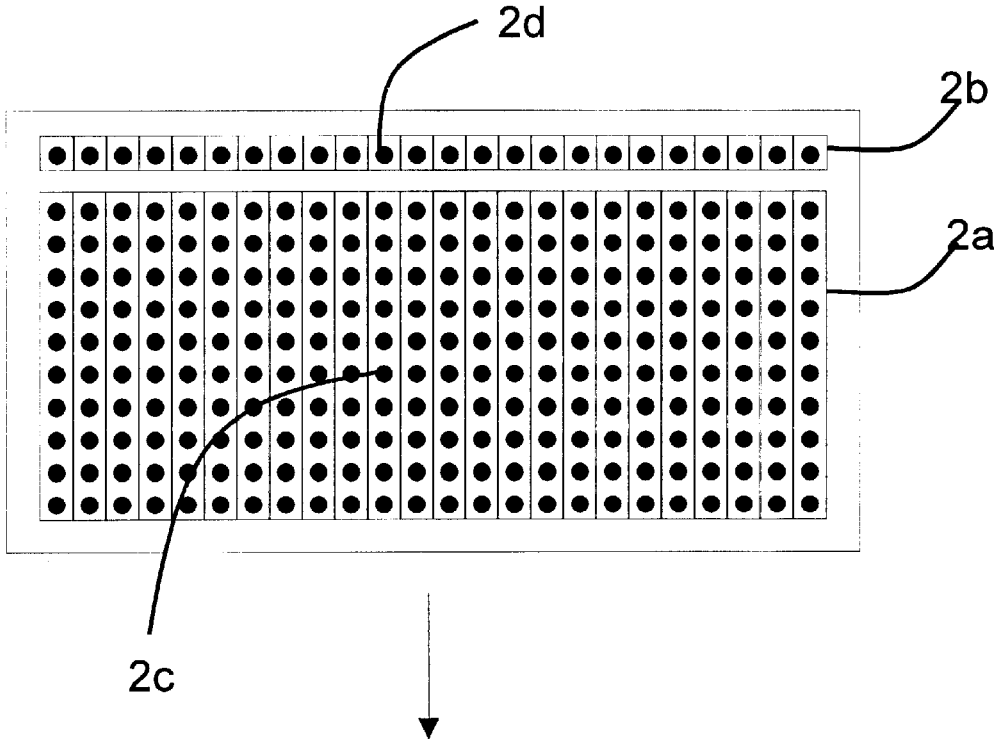
FIG. 4 shows a multi-row serial ink jet nozzle head with a single redundant backup row of nozzles.

In FIG. 4 the inkjet head 1 of FIG. 1 is shown in more detail. In the preferred embodiment chosen here, the inkjet nozzles are arranged in rows and columns. The term "column" shall be used to describe the placement of nozzles along the direction of motion of the transferring surface relative to the inkjet head as indicated by the arrow. The term "rows" is used to describe the placement of nozzles in the remaining dimension. The primary array 2*a* may have any number of rows and columns but, for the sake of clarity, we depict here 24 columns of in-line nozzles arranged in 10 rows. In what follows, we shall refer to nozzles or fluid droplet sources in general, as being "in-line" or "aligned" when they are arranged in a straight line along the direction of motion of the transferring surface relative to the array of droplet sources. To this end the alignment of the nozzles need only be within the tolerance accepted for the printed line-width in the direction of motion of the transferring surface.

In the preferred embodiment presented herewith, we have elected, for the sake of simplicity and clarity, to depict the nozzles as being in straight rows. However, the invention presented here is not restricted to this arrangement. In the general case the rows of nozzles do not need to be perpendicular to the columns, nor do the rows need to be straight or the placement of the nozzles regular, as long as the nozzles in a column are placed directly in-line with the direction of motion of the transfer surface. It is common practice in industry to have the rows non-linear and in various staggered formats. Any of these variations are compatible with the invention presented here as long as a given column of nozzles prints in-line.

The head also contains one or more rows of redundant nozzles 2*b*. In this preferred embodiment we restrict it to one row merely for the sake of clarity. The term "redundant" shall here be interpreted in the sense of backup and not in the sense of superfluous. Should, for example, nozzle 2*c* become blocked or intermittent or break, the control system of the print head will sense this failure and the role of nozzle 2*c* will be taken over by redundant nozzle 2*d* with the timing signal appropriately adapted. The matter of timing management for inkjet nozzles is well established in the industry and will not be detailed here. Systems for detecting failing nozzles and automatically replacing them have also been described and will not be discussed here.

The redundant nozzles must be in-line with the nozzles they replace, even if nozzles within a redundant row are not arranged in a straight line. The placement of redundant nozzles in-line with the nozzles they are designed to replace, allows for the use of a single redundant nozzle to serve as back-up for a number of different main nozzles in-line with it without requiring the inkjet head to be laterally translated to bring the redundant nozzle correctly into operation. Maximum printing speeds may therefore be retained despite there not being one redundant nozzle for every main nozzle. This arrangement allows redundancy to be implemented at very low cost whilst maintaining high printing speeds. As with the main nozzles, the alignment of the redundant nozzles with the main nozzles in the direction of motion of the transferring surface need only be within the tolerance accepted for the printed line-width in the direction of motion of the transferring surface.

The in-line arranged columns of inkjet nozzles in the primary array 2*a* allow the writing of each printing track by a plurality of nozzles, all part of a single head assembly. This averages out any variations between nozzles. Banding and striping, which are typical visual imperfections characterizing inkjet printing, are therefore greatly reduced without the throughput loss arising from more standard techniques such as interleaving and overwriting.

By placing the nozzles in a column aligned with the direction of motion of the transferring surface, the printing speed may be increased by a factor equal to the number of rows or the number of nozzles in a column. In the example employed here, the printing speed will be multiplied by a factor 10, being the number of rows or the number of nozzles in a column.

Figure 5:
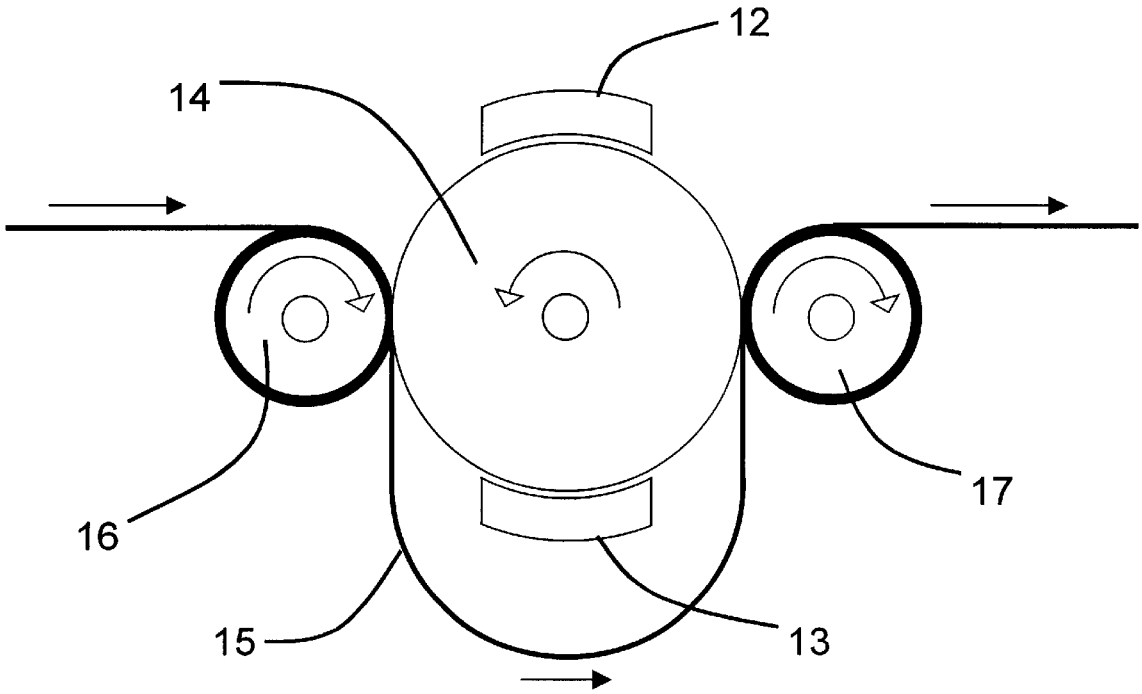
FIG. 5 shows apparatus for practising a fluid droplet transfer method according to one alternative embodiment of the invention.

In an alternative embodiment of the present invention shown in FIG. 5 inkjet heads 12 and 13 deposit inkjet patterns on drum roller 14. Each of the patterns is a subset of the total pattern such that, when correctly combined, they constitute the complete pattern. As the drum roller 14 rotates it transfers the subset droplet patterns to the printing surface 15 that is the form of a looped continuous reel. The inkjet heads are controlled by a controller, not shown in FIG. 5, that ensures the appropriate programmed delay between the sets of data representing the patterns being printed. At any given moment in time the inkjet heads 12 and 13 will be printing subset patterns of different images, as determined by the extent of the loop in the continuous reel of paper. The programmed delay is timed to compensate exactly for the loop in the continuous reel 15. Again, in keeping with standard practice in the industry, rollers 16 and 17 are elastomeric.

In another alternative embodiment of the invention the transfer surface is a continuous belt 4 with a patterned surface. This surface is chosen to be hydrophobic and has upon it a pattern of areas where water-based ink droplets will preferentially locate themselves. This may be achieved by a variety of means including making these areas less hydrophobic, by creating a physical pattern on the surface that allows the droplets to locate there or any other means that will induce the droplets to locate there in order to minimize the surface energy. This includes the selective electrostatic charging of the surface. By this approach the droplets will self-correct their spatial registration when deposited on the continuous belt transfer surface and thereby automatically correct for any off-center droplet emission by the relevant inkjet nozzles and improve the quality of the printed image. This process need not be restricted to water-based inks. The requirement is merely that the affinity of the transfer surface for the fluid droplets vary in a pattern as described above, allowing the fluid droplets to locate at such positions as will minimize the surface energy.

Figure 6:
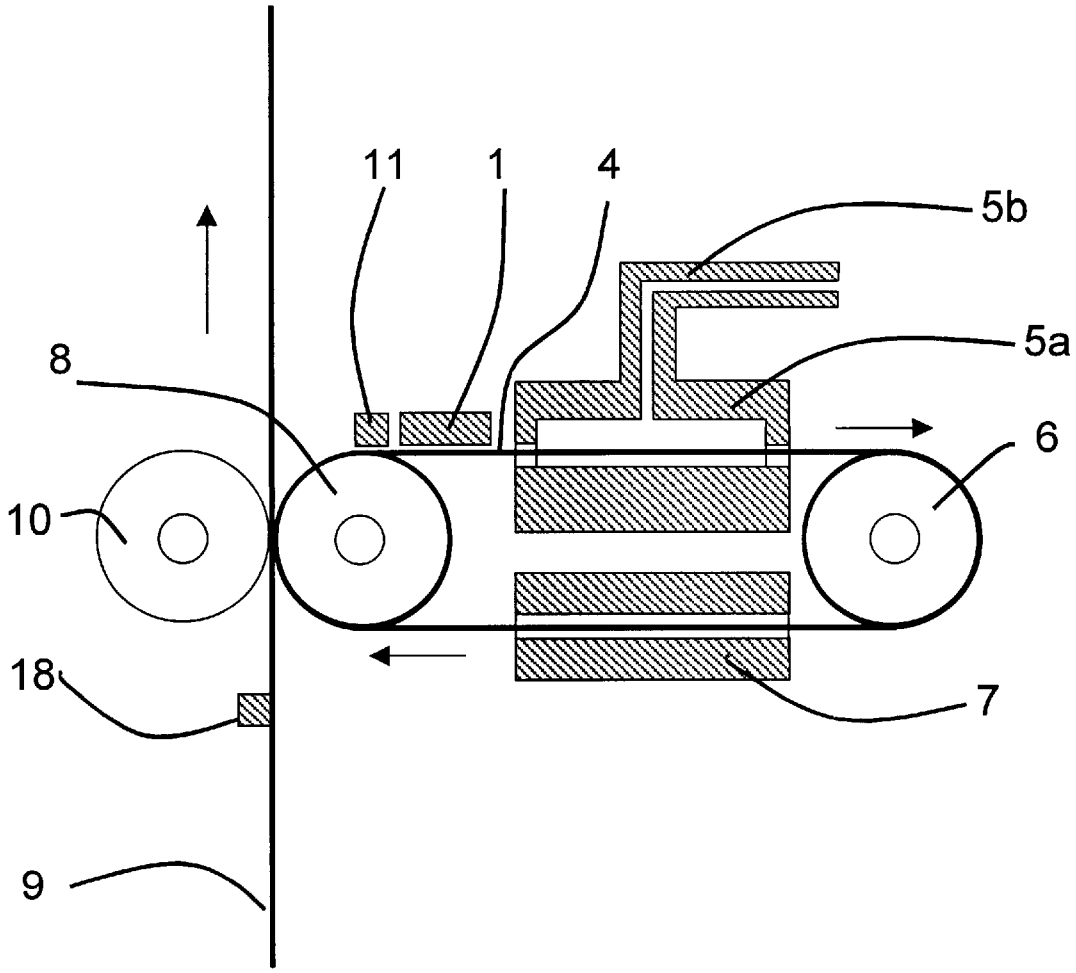
FIG. 6 shows an alternative embodiment of the invention incorporating a paper treatment step.

Yet a further embodiment of the present invention is depicted schematically in FIG. 6 where a single two-stage fluid droplet transfer unit is shown for the sake of clarity. The additional step of treating regular printing paper to improve the dot integrity is implemented by means of a paper treatment unit 18 positioned in such a way as to treat the paper before it enters between the rollers 8 and 10. One example of a treatment of the paper is to spray it with a hydrophobic liquid.

What is claimed is:

1. A method for image-wise transferring a pattern of fluid droplets from a two-dimensional array of fluid droplet sources onto a substrate via an intermediate transferring surface, said fluid droplet sources in said array being aligned with one another in a direction of motion of said transferring surface relative to said array, and said method comprising a) depositing said fluid droplets onto said transferring surface from more than one of said fluid droplet sources in-line with the direction of motion of said transferring surface;

b) changing properties of said fluid droplets after said fluid droplets have been emitted from said fluid droplet sources; and c) transferring said fluid droplets from said transferring surface to said substrate;

wherein immediately adjacent fluid droplets in said pattern are deposited onto said transferring surface at different times.

2. A method for image-wise transferring a pattern of fluid droplets from a two-dimensional array of fluid droplet sources onto a substrate via an intermediate transferring surface, said fluid droplet sources in said array being aligned with one another in a direction of motion of said transferring surface relative to said array, and said method comprising a) depositing a first subset of said fluid droplets of said pattern onto said transferring surface from more than one of said fluid droplet sources in-line with the direction of motion of said transferring surface;

b) changing properties of said subset of fluid droplets of said pattern after said fluid droplets have been emitted from said fluid droplet sources; and c) transferring said subset of said fluid droplets from said transferring surface to said substrate; and d) repeating steps a, b and c in the same order for all remaining subsets of said fluid droplets of said pattern in series.

3. A method for image-wise transferring a pattern of fluid droplets from a two-dimensional array of fluid droplet sources onto a substrate via an intermediate transferring surface, said fluid droplet sources in said array being aligned with one another in a direction of motion of said transferring surface relative to said array, and said method comprising a) depositing a first subset of said fluid droplets of said pattern onto said transferring surface from more than one of said fluid droplet sources in-line with the direction of motion of said transferring surface;

b) changing properties of said subset of said fluid droplets of said pattern after said fluid droplets have been emitted from said fluid droplet sources;

c) serially repeating steps a and b for all remaining subsets of said fluid droplets of said pattern to obtain a complete pattern; and d) transferring all of said changed fluid droplets of said complete pattern from said transferring surface to said substrate.

4. A method for image-wise transferring onto a substrate a pattern of fluid droplets from an array of fluid droplet sources, arranged in at least one dimension, via an intermediate transferring surface, said method comprising:

a) changing properties of said fluid droplets after said fluid droplets have been emitted from said fluid droplet sources; and b) transferring said fluid droplets from said transferring surface to said substrate;

wherein immediately adjacent fluid droplets in said pattern are deposited onto said transferring surface at different times.

5. A method as in claim 2 wherein said first subset of said fluid droplets of said pattern consists of fluid droplets that have no other of said fluid droplets immediately adjacent to them in said first subset of fluid droplets.

6. A method as in claim 3 wherein said first subset of said fluid droplets of said pattern consists of fluid droplets that have no other of said fluid droplets immediately adjacent to them in said first subset of fluid droplets.

7. A method as in any of claims 1 to 5 or 6 wherein said transferring surface is a surface with a periodic pattern in at least one dimensions.

8. A method as in claim 7 wherein said periodic pattern modifies a spatial registration of said fluid droplets.

9. A method as in any of claims 1 to 5 or 6 wherein said array comprises at least one row of redundant fluid droplet sources and wherein individual redundant fluid droplet sources in said row of redundant fluid droplet sources provide redundancy for any number of failed fluid droplet sources aligned with said individual redundant fluid droplet sources along the direction of motion of said transferring surface.

10. A method as in any of claims 1 to 5 or 6 wherein the additional step is performed of treating said substrate prior to transfer of said fluid droplets from said transferring surface to said substrate.

11. A method as in claim 10 wherein said substrate is regular paper.

12. A method as in claim 11 wherein said treatment comprises changing the affinity of said substrate for said fluid droplets.

* * * * *